US011363935B2

(12) United States Patent
Durham et al.

(10) Patent No.: US 11,363,935 B2
(45) Date of Patent: Jun. 21, 2022

(54) DISHWASHING APPLIANCE HAVING A VARIABLE SPRAY ASSEMBLY TO ALTERNATE THE SPRAY OF WASH FLUID

(71) Applicant: Haier US Appliance Solutions, Inc., Wilmington, DE (US)

(72) Inventors: Kyle Edward Durham, Louisville, KY (US); Craig Curtis, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 144 days.

(21) Appl. No.: 16/738,192

(22) Filed: Jan. 9, 2020

(65) Prior Publication Data

US 2021/0212547 A1 Jul. 15, 2021

(51) Int. Cl.

| | |
|---|---|
| ***A47L 15/42*** | (2006.01) |
| ***A47L 15/50*** | (2006.01) |
| ***A47L 15/14*** | (2006.01) |
| ***A47L 15/00*** | (2006.01) |

(52) U.S. Cl.

CPC ..... *A47L 15/4217* (2013.01); *A47L 15/0028* (2013.01); *A47L 15/14* (2013.01); *A47L 15/4219* (2013.01); *A47L 15/4221* (2013.01); *A47L 15/508* (2013.01); *A47L 2401/07* (2013.01); *A47L 2501/03* (2013.01)

(58) Field of Classification Search

None

See application file for complete search history.

(56) References Cited

U.S. PATENT DOCUMENTS

| | | | | |
|---|---|---|---|---|
| 5,209,454 | A * | 5/1993 | Engdahl | F16K 17/363 137/38 |
| 8,925,561 | B2 | 1/2015 | Welch | |
| 9,241,607 | B2 | 1/2016 | Porcaro, II et al. | |
| 10,076,224 | B2 | 9/2018 | Poojary et al. | |
| 10,111,576 | B2 | 10/2018 | Boyer | |
| 10,349,808 | B2 | 7/2019 | Fawaz et al. | |
| 2010/0139719 | A1* | 6/2010 | Gnadinger | A47L 15/4282 134/56 D |
| 2012/0138110 | A1* | 6/2012 | Chen | A47L 15/4278 134/198 |

(Continued)

FOREIGN PATENT DOCUMENTS

WO WO2018107835 A1 6/2018

*Primary Examiner* — Michael E Barr
*Assistant Examiner* — Omair Chaudhri
(74) *Attorney, Agent, or Firm* — Dority & Manning, P.A.

(57) ABSTRACT

A dishwashing appliance or variable spray assembly, as provided herein, may include a manifold body, a diverter valve, and a driver. The manifold body may define a fluid inlet, a first flow path, a second flow path, a first spray outlet, and a second spray outlet. The first and second flow paths may be downstream from the fluid inlet. The second flow path may be in fluid parallel to the first flow path. The second spray outlet may be spaced apart from the first spray outlet. The diverter valve may be mounted within manifold body and movable between a first zone position directing wash fluid to the first flow path and a second zone position directing wash fluid to the second flow path. The driver may be disposed outside of the manifold body to motivate the diverter valve between the first zone position and the second zone position.

15 Claims, 9 Drawing Sheets

(56) References Cited

U.S. PATENT DOCUMENTS

| | | | | |
|---|---|---|---|---|
| 2013/0092194 | A1* | 4/2013 | Carlson | A47L 15/428 134/198 |
| 2015/0250374 | A1* | 9/2015 | McDaniel | A47L 15/505 134/198 |
| 2018/0110396 | A1* | 4/2018 | Fawaz | A47L 15/4214 |
| 2018/0168430 | A1* | 6/2018 | Wilson | A47L 15/0028 |
| 2018/0249885 | A1* | 9/2018 | Fawaz | A47L 15/23 |
| 2018/0368654 | A1* | 12/2018 | Pugh | A47L 15/4278 |

* cited by examiner

DISHWASHING APPLIANCE HAVING A VARIABLE SPRAY ASSEMBLY TO ALTERNATE THE SPRAY OF WASH FLUID

FIELD OF THE INVENTION

The present subject matter relates generally to washer appliances, and more particularly to dishwashing appliances having one or more variable assemblies.

BACKGROUND OF THE INVENTION

A dishwasher or dishwashing appliances generally includes a tub that defines a wash chamber for receipt of articles for washing. Certain dishwashing appliances also include a rack assembly slidably mounted within the wash chamber. A user can load articles, such as plates, bowls, glasses, or cups, into the rack assembly, and the rack assembly can support such articles within the wash chamber during operation of the dishwashing appliance.

Typically, a dishwasher or dishwashing appliance has multiple locations at which fluids must be delivered for cleaning and rinsing articles into the chamber of the dishwasher. For example, the dishwasher may include multiple spray body assemblies such as one under a bottom dishwasher rack and another under the top dishwasher rack. An additional spray device may also be provided over the top dishwasher rack. Some dishwashers may also include a fluid spray specifically for a basket or other compartment that holds silverware. Depending upon, for example, what items or where certain items are loaded within the dishwashing appliance, it may be desirable to control when fluids are provided to particular locations in the dishwasher during a wash or rinse cycle.

Certain applications may have some ability to switch the delivery of fluid between different locations or components in the dishwasher (e.g., during a cycle). For example, some dishwashers include a diverter proximate to the pump to alternate the delivery of fluid between top and bottom spray assemblies. Unfortunately, though, these conventional approaches do not permit the delivery of fluid to vary based on which particular area needs the fluid. In other words, conventional appliances spray the same areas regardless of what articles are in the dishwasher or what spray assemblies might be more appropriate for cleaning a particular article. Moreover, conventional diverters positioned upstream of every spray assembly of a dishwasher generally require complex controls that affect the delivery of fluid to all spray assemblies of the dishwasher.

Accordingly, it would be advantageous to provide a variable assembly for alternately supplying wash fluid to multiple predetermined locations within the wash chamber (e.g., based on articles within the chamber, the location at which articles are placed, or a wash cycle). Specifically, it would be useful if such an assembly was configured to provide wash fluid efficiently, without affecting the flow to other spray assemblies, or without requiring a changes to a diverter upstream from multiple spray assemblies.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a variable spray assembly for a dishwashing appliance is provided. The variable spray assembly may include a manifold body, a diverter valve, and a driver. The manifold body may be mountable within a wash chamber of the dishwashing appliance. The manifold body may define a fluid inlet, a first flow path, a second flow path, a first spray outlet, and a second spray outlet. The fluid inlet may receive a wash fluid within the manifold body. The first flow path may be downstream from the fluid inlet. The second flow path may be downstream from the fluid inlet and in fluid parallel to the first flow path. The first spray outlet may be downstream from the first flow path. The second spray outlet may be downstream from the second flow path and be spaced apart from the first spray outlet. The diverter valve may be mounted within manifold body downstream from the fluid inlet. The diverter valve may be movable between a first zone position directing wash fluid to the first flow path and a second zone position directing wash fluid to the second flow path. The driver may be disposed outside of the manifold body in selective engagement with the diverter valve to motivate the diverter valve between the first zone position and the second zone position.

In another exemplary aspect of the present disclosure, a dishwashing appliance is provided. The dishwashing appliance may include a tub, a pump, a spray assembly, a rack assembly, and a variable spray assembly. The tub may define a wash chamber. The pump may be configured to deliver a wash fluid into the wash chamber. The spray assembly may be housed within the wash chamber of the tub in fluid communication with the pump to receive wash fluid therefrom. The rack assembly may be slidably disposed within the wash chamber. The variable spray assembly may be housed within the wash chamber of the tub in fluid communication with the pump to receive wash fluid therefrom. The variable spray assembly may include a manifold body, a diverter valve, and a driver. The manifold body may define a fluid inlet, a first flow path, a second flow path, a first spray outlet, and a second spray outlet. The fluid inlet may receive a wash fluid within the manifold body. The first flow path may be downstream from the fluid inlet. The second flow path may be downstream from the fluid inlet and in fluid parallel to the first flow path. The first spray outlet may be downstream from the first flow path. The second spray outlet may be downstream from the second flow path and be spaced apart from the first spray outlet. The diverter valve may be mounted within manifold body downstream from the fluid inlet. The diverter valve may be movable between a first zone position directing wash fluid to the first flow path and a second zone position directing wash fluid to the second flow path. The driver may be disposed outside of the manifold body in selective engagement with the diverter valve to motivate the diverter valve between the first zone position and the second zone position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
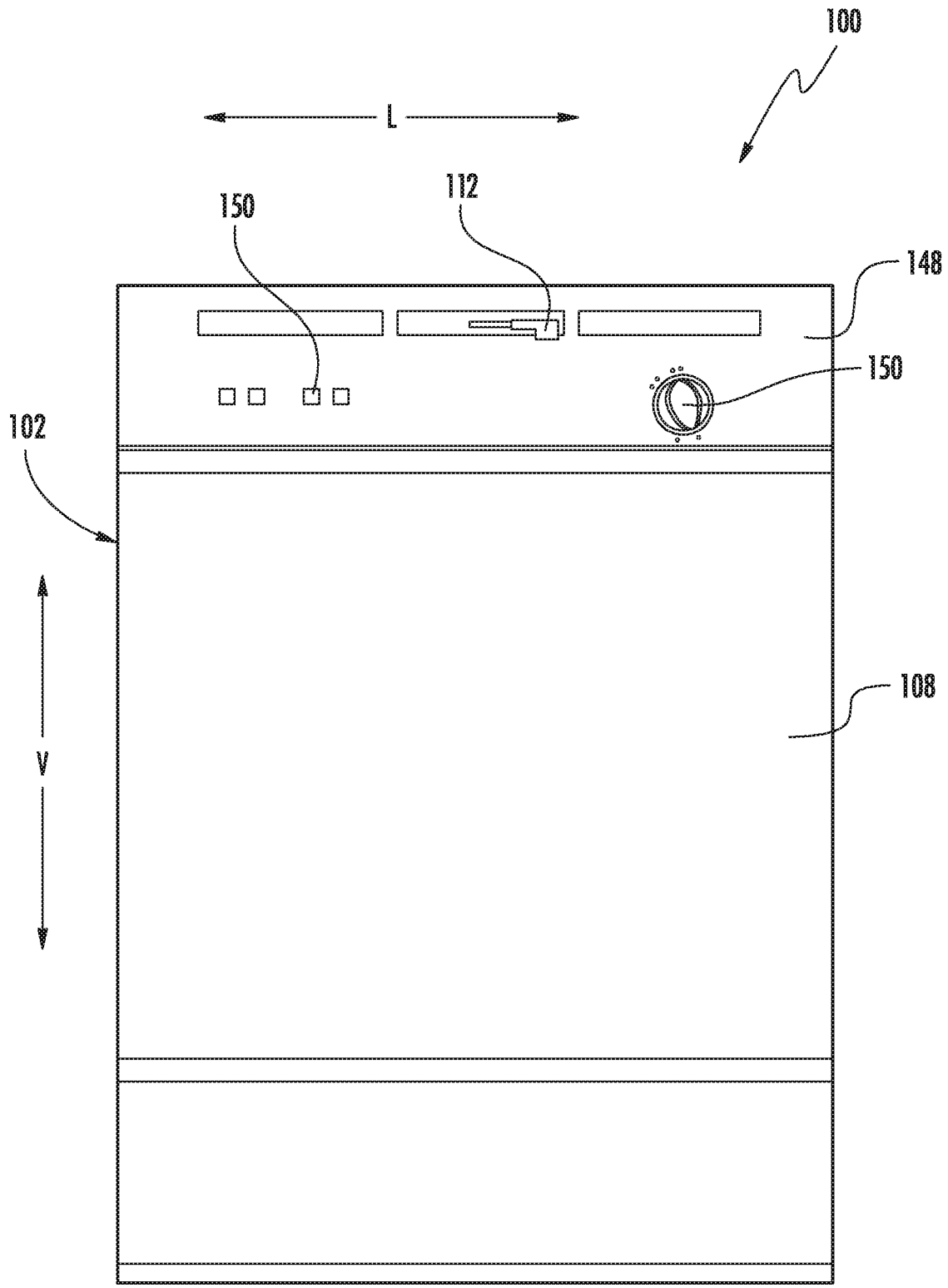
FIG. 1 provides a front elevation view of a dishwashing appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
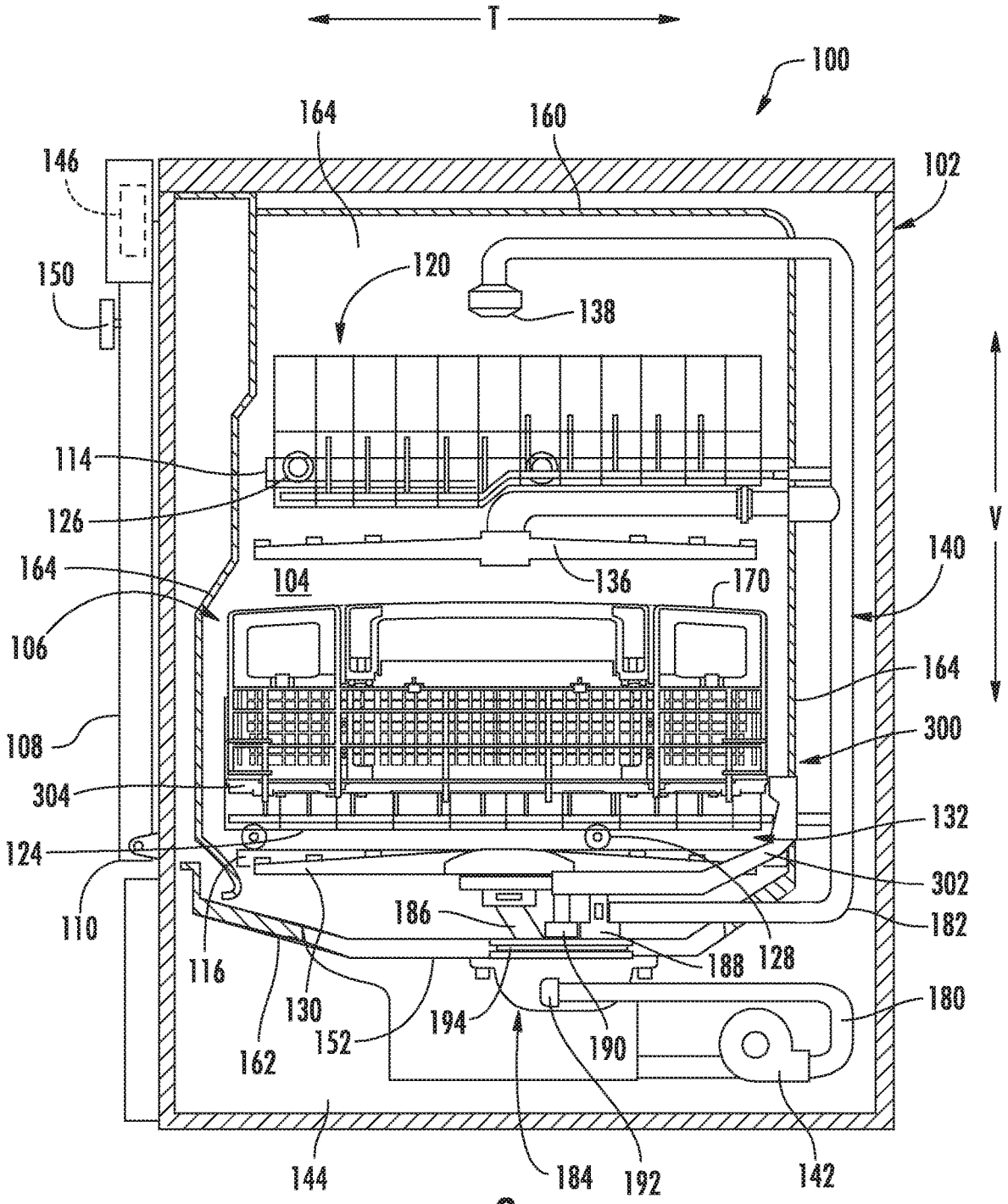
FIG. 2 provides sectional elevation view of the exemplary dishwashing appliance of FIG. 1.

Turning now to the figures, FIGS. 1 and 2 illustrate exemplary embodiments of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. Optionally, a latch 112 may be used to lock and unlock the door 108 for access to the chamber 106.

Generally, the tub 104 may define a discrete vertical direction V, lateral direction L, and transverse direction T. Vertical direction V, lateral direction L, and transverse direction T are orthogonally oriented such that vertical direction V, lateral direction L, and transverse direction T form an orthogonal directional system.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., three sidewalls) extending between the top and bottom walls 160, 162. It should be appreciated that the tub 104 may generally be formed from any suitable material. For instance, in several embodiments, the tub 104 is formed from a ferritic material, such as stainless steel, or a polymeric material.

As particularly shown in FIG. 2, upper and lower guide rails 114, 116 may be mounted on opposing sidewalls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack 120, 122 is substantially positioned outside the wash chamber 106, and a retracted position (shown in FIGS. 1 and 2) in which the rack 120, 122 is located inside the wash chamber 106. This may be facilitated by rollers 126 and 128, for example, mounted onto racks 120 and 122, respectively.

In some embodiments, a basket 170 is removably mounted to lower rack assembly 122. In additional or alternative exemplary embodiments, the basket can be selectively or removably attached to other portions of dishwashing appliance 100 (e.g., upper rack assembly 120 or door 108). The basket 170 defines one or more storage chambers and is generally configured to receive of silverware, flatware, utensils, and the like, that are too small to be accommodated by the upper and lower rack assemblies 120, 122. The basket 170 may be constructed of any suitable material (e.g., metal or polymer) and define a plurality of fluid slots 178 for permitting wash fluid therethrough.

The dishwashing appliance 100 includes one or more spray assemblies housed within the wash chamber 106. For instance, the dishwashing appliance 100 may include a lower spray-arm assembly 130 that is rotatably mounted within a lower region 132 of the wash chamber 106 directly above the bottom wall 162 of the tub 104 so as to rotate in relatively close proximity to the rack assembly 122. As shown in FIG. 2, a mid-level spray-arm assembly 136 may be located in an upper region of the wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating fluid (e.g., water and dishwasher fluid) within the tub 104. As shown in FIG. 2, the fluid circulation assembly 140 may also include a pump 142 located in a machinery compartment 144 located below the bottom wall 162 of the tub 104. One or all of the spray assemblies 130, 136, 138 may be in fluid communication with the pump 142 (e.g., to receive a pressurized wash fluid therefrom). Additionally, each spray-arm assembly 130, 136 may include an arrangement of discharge ports or orifices for directing washing liquid onto dishes or other articles located in rack assemblies 120 and 122, which may provide a rotational force by virtue of wash fluid flowing through the discharge ports. The resultant rotation of the lower spray-arm assembly 130 provides coverage of dishes and other dishwasher contents with a spray (e.g., a spray of wash fluid).

It should be appreciated that, although the dishwashing appliance 100 will generally be described herein as including three spray assemblies 130, 136, 138, the dishwashing appliance may, in alternative embodiments, include any other number of spray assemblies, including two spray assemblies, four spray assemblies or five or more spray assemblies. For instance, in addition to the lower and mid-level spray-arm assemblies 130, 136 and the upper spray assembly 138 (or as an alternative thereto), the dishwashing appliance 100 may include one or more other spray assemblies or wash zones for distributing fluid within the wash chamber 106.

In addition to the three spray assemblies 130, 136, 138, the appliance 100 also includes a variable jet assembly 300 disposed within the wash chamber 106. In some embodiments, the variable jet assembly 300 can remain generally stationary during use of the dishwashing appliance 100 (e.g., such that there is no intentional movement of variable jet assembly 300 outside of vibration, etc.). In additional or alternative embodiments, one or more movable nozzles (not pictured) may be provided on a manifold body 304 to rotate during use of the dishwashing appliance 100 (e.g., while manifold body 304 remains stationary).

The variable jet assembly 300 may be positioned to alternately direct wash fluid to multiple predetermined locations within the wash chamber 106 (e.g., different subsections of the wash chamber 106 or a corresponding rack 314). For instance, the variable jet assembly 300 may be disposed within wash tub 104 (e.g., on or within the lower rack assembly 122) and directed toward a discrete first spray zone and second spray zone of the basket 170. In exemplary embodiments, the variable jet assembly 300 may provide advantageously focused cleaning to utensils at different portions of basket 170. Additionally or alternatively, delivery of wash fluid may be advantageously determined or influenced based on where utensils are within basket 170. Further additionally or alternatively, delivery of wash fluid from variable jet assembly 300 may be provided without significantly blocking spray from a spray assembly (e.g., lower spray-arm assembly 130).

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In some embodiments, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In such an embodiment, input/output ("I/O") signals may be routed between the control system and various operational components of dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. The user interface 150 may be in communication with the controller 146 via one or more signal lines or shared communication busses.

Additionally, as shown in FIG. 2, a portion of the bottom wall 162 of the tub 104 may be configured as a tub sump portion 152 that is configured to accommodate one or more components of the fluid recirculation assembly 140 (e.g., a filter assembly (not shown) or other components). It should be appreciated that, in several embodiments, the bottom wall 162 of the tub 104 may be formed as a single, unitary component such that the tub sump portion 152 as well as the surrounding portions of the bottom wall 162 are formed integrally with one another. Alternatively, the tub sump portion 152 may be configured as a separate component configured to be attached to the remaining portion(s) of the bottom wall 162.

Moreover, as shown in FIG. 2, the fluid recirculation assembly 140 may also include a diverter assembly 184 in fluid communication with the pump 142 for diverting fluid between one or more of the spray-arm assemblies 130, 136, 138. For example, the diverter assembly 184 may, in several embodiments, include an inlet 192 coupled to the pump 142 (e.g., via pump conduit 180 shown in FIG. 2) for directing fluid into the diverter assembly 184 and first and second outlets 186, 188 for directing the fluid received from the pump 142 to the lower spray-arm assembly 130 or the mid-level and upper spray-arm assemblies 136, 138, respectively. In some such embodiments, the first outlet 186 may be configured to be directly coupled to the lower spray-arm assembly 130 and the second outlet 188 may be coupled to a suitable fluid conduit 182 of the fluid recirculation assembly 140 for directing fluid to the mid-level and upper spray-arm assemblies 136, 138. Optionally, a third outlet 190 may be direct the fluid received from the pump 142 to the variable jet assembly 300. Additionally, the diverter assembly 184 may also include a diverting valve 194 to selectively divert the flow of fluid through the assembly 184 to the first outlet 186, the second outlet 188, or the third outlet 190.

It should be appreciated that the present subject matter is not limited to any particular style, model, or configuration of dishwashing appliance. The exemplary embodiments depicted in FIGS. 1 and 2 are simply provided for illustrative purposes only. For example, different locations may be provided for the user interface 150, different configurations may be provided for the racks 120, 122, and other differences may be applied as well.

Referring now to FIGS. 3 through 8, several view of an exemplary embodiment of the variable jet assembly 300, including components thereof, are provided. Variable jet assembly 300 may include a fluid conduit 302 and manifold body 304 in selective fluid communication with pump 142 (FIG. 2). Generally, variable jet assembly 300 defines a discrete first spray zone and second spray zone at which water or wash fluid may be dispensed (e.g., from pump 142 or diverter assembly 184). In some embodiments, first spray zone is configured to receive one or more elongated utensils (e.g., bottles). In additional or alternative embodiments, the basket 170 can be selectively positioned or mounted proximate to the variable jet assembly 300 (e.g., at second spray zone).

Figure 3:
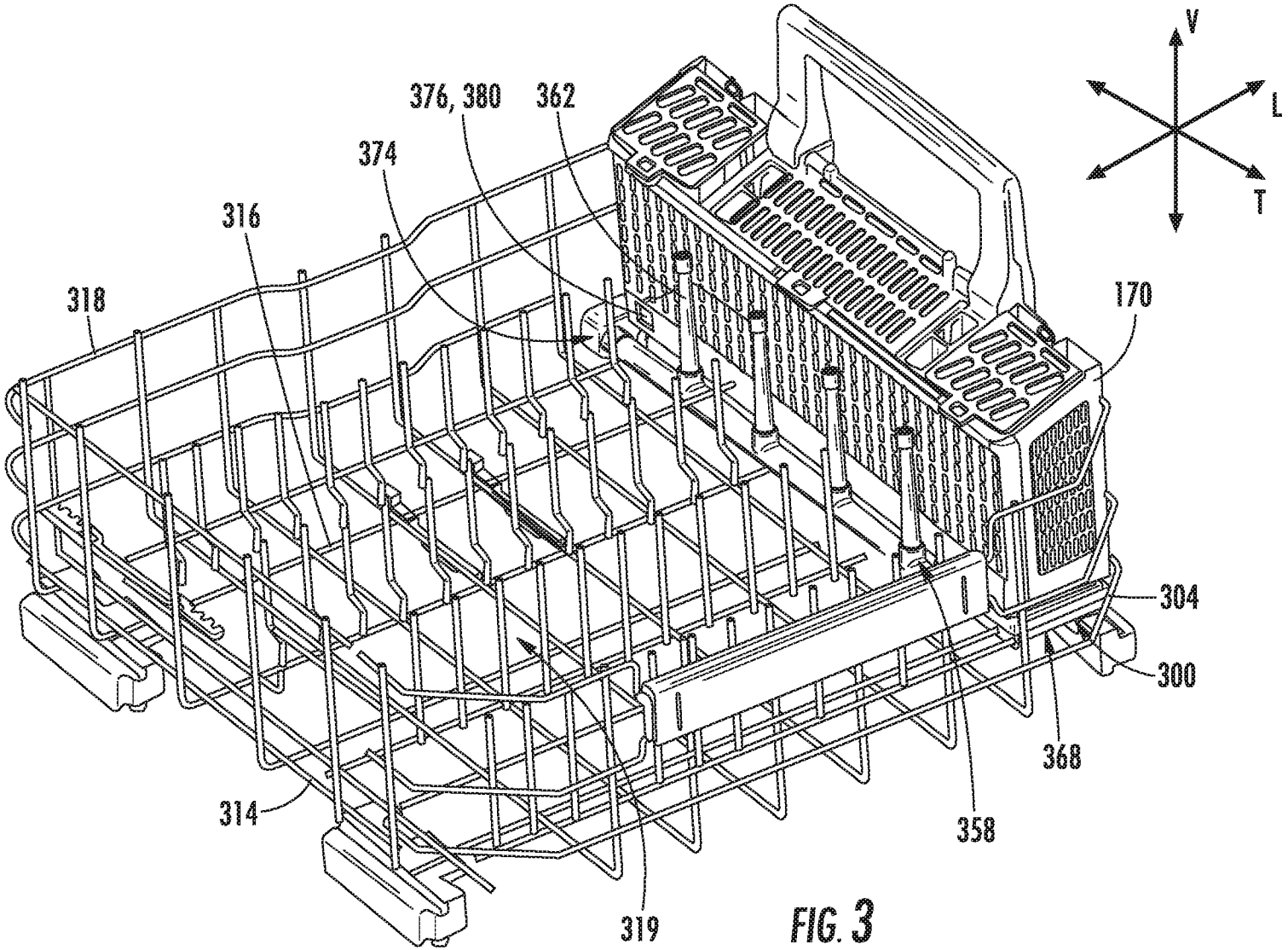
FIG. 3 provides a perspective view of several components of the exemplary dishwashing appliance of FIG. 2, including a rack assembly and variable jet assembly.
Figure 4:
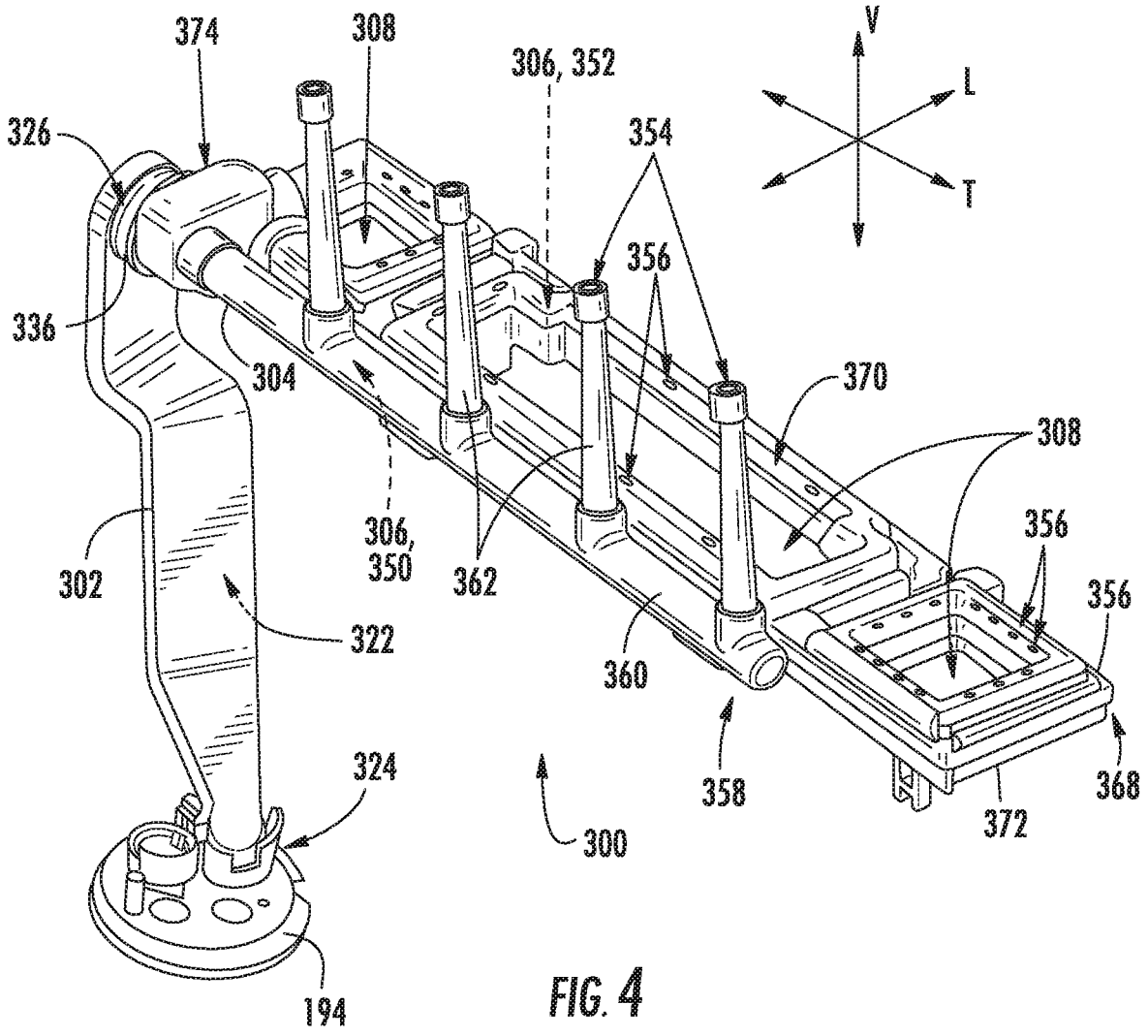
FIG. 4 provides a perspective view of the exemplary variable jet assembly of FIG. 3.

As illustrated in FIGS. 3 and 4, the variable jet assembly 300 includes a manifold body 304 defining an interior passage 306 to direct wash fluid from the fluid conduit 302. The manifold body 304 may define a fluid inlet 334 upstream from an interior passage 306 that defines a separate first flow path 350 and second flow path 352. First and second flow paths 350, 352 are generally defined in fluid parallel upstream from one or more respective first spray outlet(s) 354 and second spray outlet(s) 356. During use, wash fluid may thus be directed into the wash chamber 106 from the first or second spray outlets 354, 356 (e.g., after passing into the interior passage 306 through fluid inlet 334 from the fluid conduit 302).

In some embodiments, at least a portion of the variable jet assembly 300 (e.g., the manifold body 304) is mounted to a rack assembly 314. It should be noted that the rack assembly 314 may be embodied as a lower rack assembly 122 or an upper rack assembly 120, as illustrated in FIG. 2. In turn, in some embodiments wherein the rack assembly 314 is a lower rack assembly 122, the upper rack assembly 120 will be disposed above the rack assembly 314. The rack assembly 314 may generally include a bottom wall 316 and a plurality of side walls 318 defining an interior volume or wash compartment 319 for receiving articles to be washed. Each wall 316, 318 may be formed from a lattice structure, as described above. Optionally, the wash compartment 319 may receive the manifold body 304. Additionally or alternatively, the wash compartment 319 may selectively receive the basket 170 therein.

In optional embodiments, the first spray zone is defined at a portion of manifold body 304 that includes a bottle washer assembly 358. Such a bottle washer assembly 358 may be positioned or oriented for directing a fluid from first flow path 350 towards or into rack assembly 314 through one or more first spray outlets 354 (e.g., a plurality of outlets 354 in fluid parallel with each other). In some such embodiments, bottle washer assembly 358 includes a base 360 mounted to rack assembly 314 at bottom wall 316 of rack assembly 314. Bottle washer assembly 358 may include one or more spray tines 262, each of which defining a discrete first spray outlet 354. Articles, and in particulars bottles (such as baby bottles), cups, glasses, etc., may be positioned on or over spray tines 262. Spray tines 262 are mounted to a main conduit of base 360 and can extend into the wash compartment 319 of rack assembly 314 (e.g., upwardly along the vertical direction V). In particular, spray tines 262 of bottle washer assembly 358 may be distributed between fixed tines of bottom wall 316. For example, each spray tine 262 of bottle washer assembly 358 may be positioned between respective pairs of fixed tines. Spray tines 262 may assist with supporting articles within wash compartment 319 of rack assembly 314. In addition, each spray tine 262 may emit a stream of wash fluid during operation of bottle washer assembly 358. The stream of wash fluid is directed against or onto an article positioned over or on each respective one of spray tines 262. The first spray outlet(s) 354 may thus be in fluid communication between the interior passage 306 and the wash chamber 106 (FIG. 2).

In additional or alternative exemplary embodiments, the second spray zone is defined at a portion of manifold body 304 that includes basket washer assembly 368. Such a basket washer assembly may be positioned or oriented for directing a fluid from second flow path 352 towards or into rack assembly 314. Basket washer assembly 368 may include a nozzle having an upper face 370 and a lower face 372 that are joined together (e.g., selectively or, alternatively, fixedly) to define the second flow path 352. When assembled, upper face 370 may defining one or more second spray outlets 356 (e.g., a plurality of outlets 356 in fluid parallel with each other). Optionally, the upper face 370 and lower face 372 may extend about one or more exterior holes 308 at second spray zone. Each exterior hole 308 may extend along a central axis (e.g., parallel to the vertical direction V from the upper face 370 of the manifold body 304 to the lower face 372 of the manifold body 304. Exterior hole 308 may thus provide a void through which fluid may pass, independent of the second spray outlet(s) 356. During use, the second spray outlet(s) 356 direct a stream of wash fluid upward. For instance, the stream of wash fluid may be directed against or onto basket 170 or an article positioned over basket washer assembly 368 (e.g., separately and in fluid parallel to first spray outlet(s) 354). The second spray outlet(s) 356 may thus be in fluid communication between the interior passage 306 and the wash chamber 106 (FIG. 2).

Figure 5:
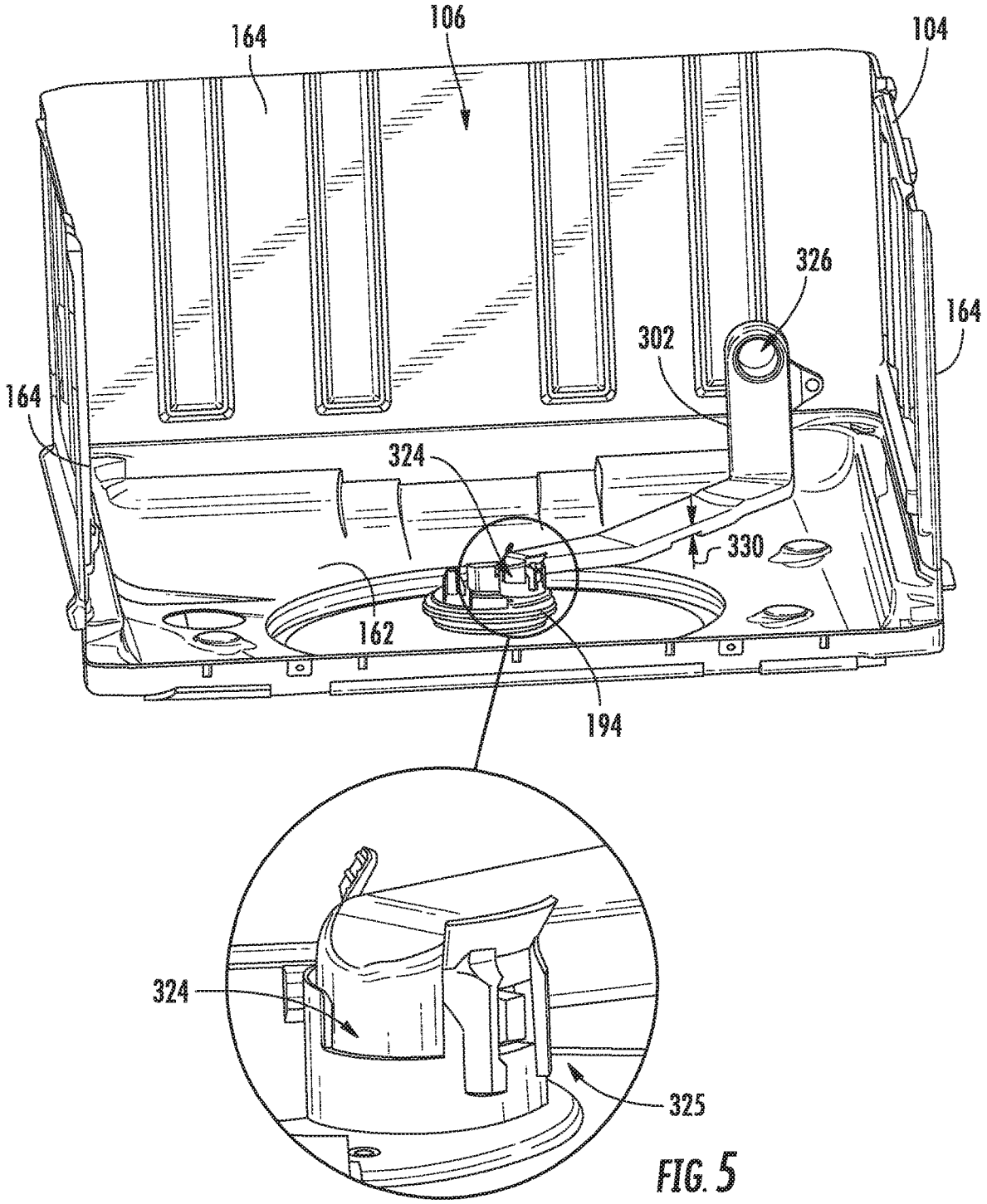
FIG. 5 provides a perspective view of a portion of the exemplary dishwashing appliance of FIG. 2, including a magnified view of a portion of a fluid conduit.
Figure 6:
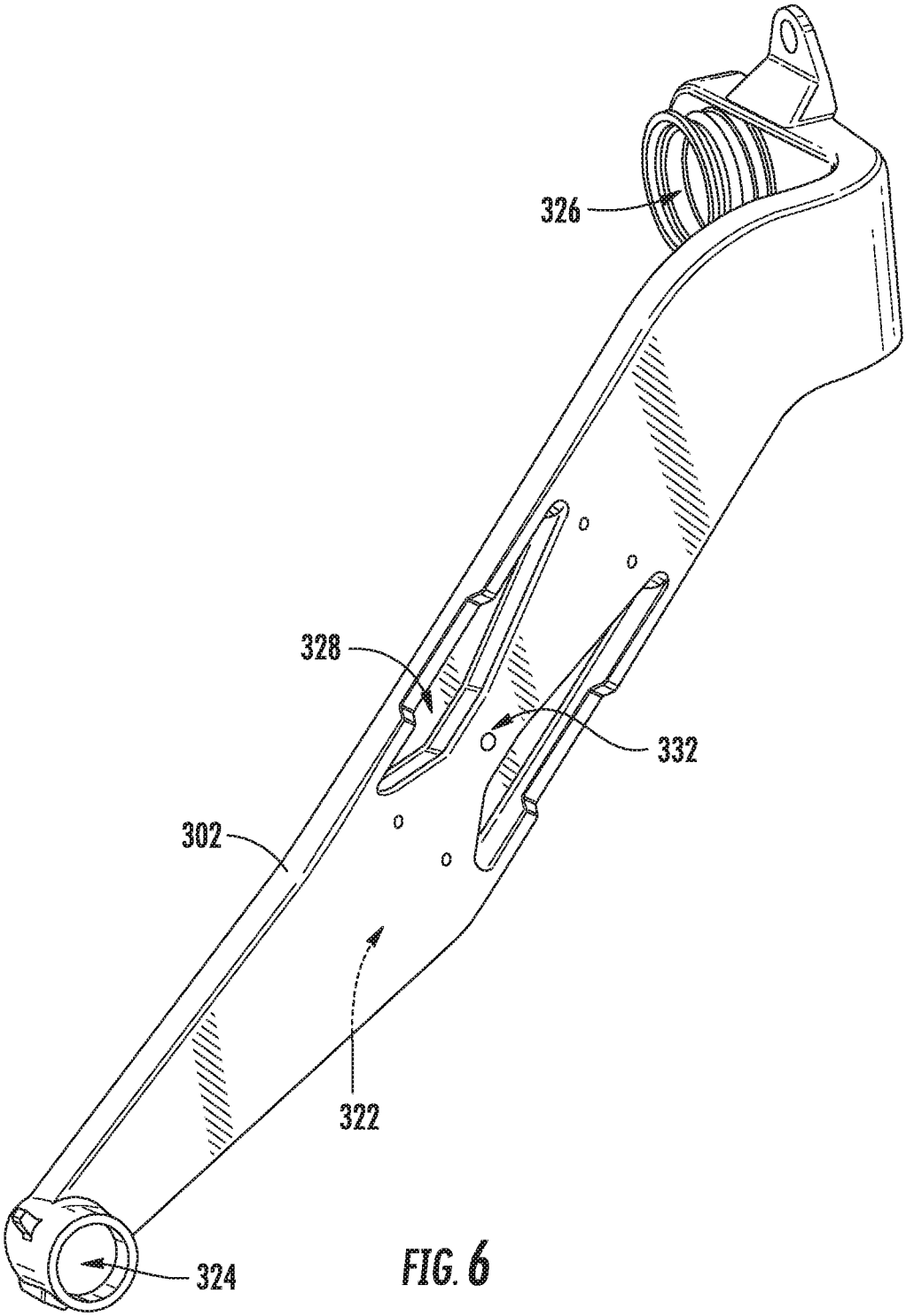
FIG. 6 provides a bottom perspective view of the fluid conduit of the exemplary dishwashing appliance of FIG. 2.

As illustrated in FIGS. 4 through 6, the fluid conduit 302 may be provided in selective fluid communication with the manifold body 304. When assembled, the fluid conduit 302 is generally disposed inside the tub 104. Specifically, the fluid conduit 302 may be fixed to the tub 104 within the wash chamber 106. In some such embodiments, the fluid conduit 302 is mounted to the tub 104 via one or more mechanical fasteners (e.g., bolts, clasps, screws, ties, etc.). The fluid conduit 302 may define a conduit passage 322 extending between a conduit inlet 324 and a conduit outlet 326 (e.g., to direct wash fluid therethrough). The conduit inlet 324 may be attached to the diverting valve 194 to selectively receive wash fluid from the pump 142 (FIG. 2), as described above. For instance, a pair of male-female tabs 325 may be provided at the conduit inlet 324 to removably secure the fluid conduit 302 to the diverting valve 194. The conduit outlet 326 may selectively attach to the manifold body 304 (e.g., as the rack assembly 314 alternately moves in and out of wash chamber 106).

Figure 7:
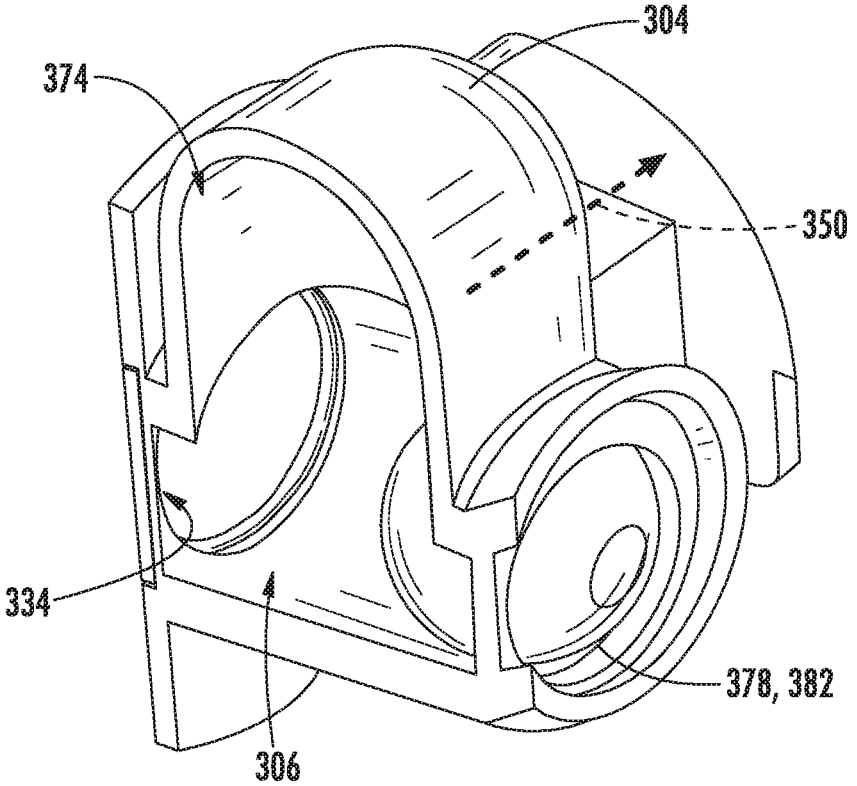
FIG. 7 provides a sectional view of a portion of a diverter valve of a variable jet assembly according to exemplary embodiments of the present disclosure, wherein the variable jet assembly is in a first zone position.

In some embodiments, the conduit passage 322 includes a Venturi portion 328 (see FIG. 7). The Venturi portion 328 may increase pressure of wash fluid upstream therefrom, while increasing the velocity of wash fluid being directing through the Venturi portion 328. Advantageously, the increased velocity of wash fluid being directed through the Venturi portion 328 may reduce the amount of washing liquid that might otherwise leak (e.g., from the drain hole 332 during operation).

An air gap 330 may be defined (e.g., in the vertical direction V) between a bottom portion of the fluid conduit 302 and a wall of the tub 104. For instance, as illustrated, the air gap 330 may be defined between the fluid conduit 302 and the bottom wall 162. Optionally, a drain hole 332 may be defined through the fluid conduit 302 (e.g., at the bottom portion of the fluid conduit 302). The drain hole 332 may be in fluid communication between the conduit passage 322 and the wash chamber 106 or air gap 330. In certain embodiments, the drain hole 332 is defined through the fluid conduit 302 along the Venturi portion 328. Once pressurized wash fluid is no longer supplied to the fluid conduit 302 (e.g., from the pump 142—FIG. 2), wash fluid remaining in the conduit passage 322 may flow to the wash chamber 106 through the drain hole 332 (e.g., as motivated by gravity and the shape of the fluid conduit 302).

As noted above, the fluid conduit 302 may selectively attach to the manifold body 304. Specifically, the manifold body 304 defines an inlet 334 that may be removably or selectively connected to the fluid conduit 302 (e.g., at the conduit outlet 326). The connection between the manifold body 304 and the fluid conduit 302 may be alternately formed and broken as the manifold body 304 slides into and out of the wash chamber 106 (e.g., with the rack assembly 314—FIG. 3). In certain embodiments, the fluid conduit 302 includes a resilient bellow 336 extending from the conduit outlet 326. The resilient bellow 336 may extend toward the inlet 334 (e.g., in contact with the inlet 334). The resilient bellow 336 may be formed to generally compress when engaged with the manifold body 304. Conversely, the resilient bellow 336 may expand outward (e.g., away from the outlet 326 of the fluid conduit 302 when the manifold body 304 is removed from engagement therewith). When connected, wash fluid may flow from the conduit outlet 326, through the resilient bellow 336, and to the inlet 334. The resilient bellow 336 may be formed from a suitable elastic material, such as one or more polymer or rubber material.

Figure 8:
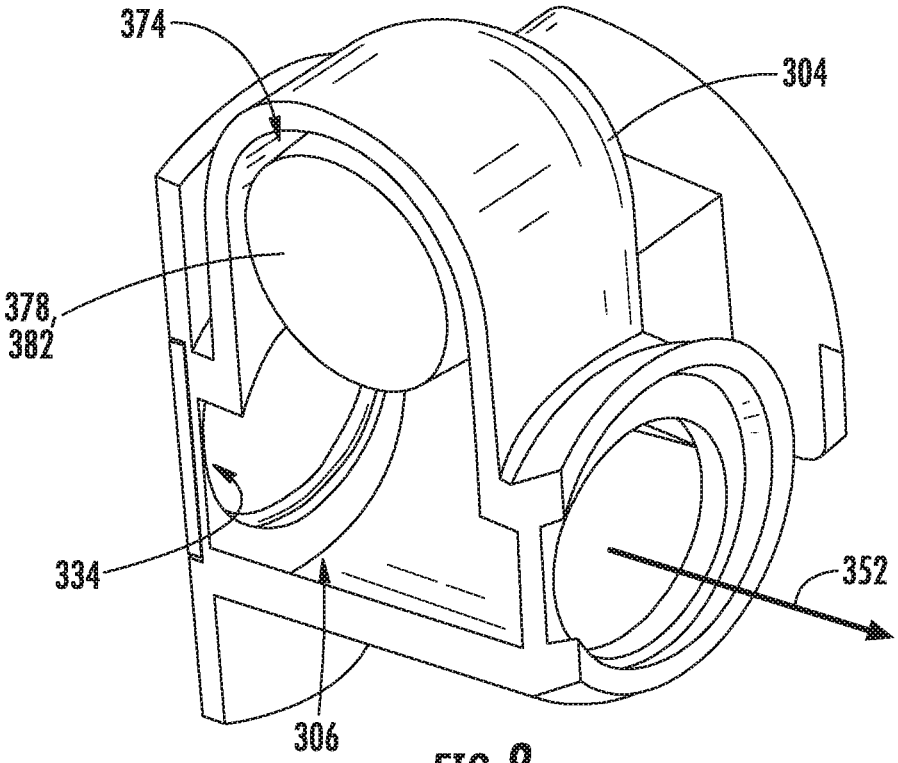
FIG. 8 provides a sectional view of a portion of the exemplary diverter valve of FIG. 7, wherein the variable jet assembly is in a second zone position.

Turning especially to FIGS. 4, 7, and 8, a diverter valve 374 and a driver 376 may be provided on manifold body 304 to selectively or alternately direct wash fluid between the first spray zone and second spray zone. In particular, diverter valve 374 may be moved between a first zone position (e.g., FIG. 7) and a second zone position (e.g., FIG. 8). As will be described below, in the first zone position, diverter valve 374 may direct wash fluid to the first flow path 350, and thereby to the first spray outlet(s) 354. By contrast, in the second position diverter valve 374 may direct wash fluid to the second flow path 352, and thereby to the first spray outlet(s) 354.

Generally, diverter valve 374 is mounted within manifold body 304. In particular, diverter valve 374 is mounted downstream from fluid inlet 334. Thus, diverter valve 374 is downstream from diverter valve 374 or fluid conduit 302. Additionally or alternatively, diverter valve 374 may move with manifold body 304 (e.g., as the rack assembly 314 alternately moves in and out of wash chamber 106). When assembled, diverter valve 374 may at least partially define the branch or redirection point for first and second flow paths 350, 352. For instance, diverter valve 374 may include a valve body connecting or joining the bottler washer assembly (e.g., at the base 360) and the basket washer assembly 368 (e.g., at the nozzle). Thus, although first and second flow paths 350, 352 may be defined as fluid-parallel alternate wash paths, first and second flow paths 350, 352 may both be located downstream from diverter valve 374.

As shown, driver 376 is disposed outside of manifold body 304. Nonetheless, driver 376 may be in selective engagement with diverter valve 374 to move or motivate diverter valve 374 between the first zone position and the second zone position. Engagement with driver 376 may cause diverter valve 374 to move from the first zone position to the second zone position, or vice versa. Thus, the position of the diverter valve 374 may be based on or determined by the position of the driver 376. For instance, positioning the driver 376 away from the manifold body 304 may cause the diverter valve 374 to assume the first zone position (e.g., such that water or wash fluid from fluid inlet 334 is directed to the first spray outlet 354). By contrast, positioning the driver 376 in engagement with diverter valve 374 (e.g., on or near the first spray zone) may cause the diverter valve 374 to assume the second zone position (e.g., such that water or wash fluid from fluid inlet 334 is directed to the second spray outlet 356).

Generally, driver 376 mechanically communicates with diverter valve 374 to move diverter valve 374 between the first and second zone position. In some embodiments, the mechanical communication is driven by magnetic engagement between driver 376 and diverter valve 374. For instance, diverter valve 374 may include a first magnetic element 378 while driver 376 includes a second magnetic element 380. These magnetic elements 378, 380 may be formed from any material that is suitably responsive to a magnetic field or capable of generating a magnetic field. In other words, the first and second magnetic elements 378, 380 are not formed from a purely diamagnetic material. For instance, the magnetic elements 378, 380 may be a permanent magnet, ferromagnetic element, or electromagnetic element. When assembled, the magnetic engagement between first and second magnetic elements 378, 380 may cause diverter valve 374 to move from first zone position to second zone position. In other words, bringing driver 376 and second magnetic element 380 in close proximity to first magnetic element 378 may place diverter valve 374 in the second zone position.

As illustrated in FIGS. 7 and 8, in some embodiments, diverter valve 374 includes a stopper ball 382. Stopper ball 382 may slide within manifold to selectively close first flow path 350 and second flow path 352 (e.g., place diverter valve 374 in the second zone position and first zone position, respectively). Stopper ball 382 may further include a permanent magnet or ferromagnetic material and thus form first magnetic element 378.

Figure 9:
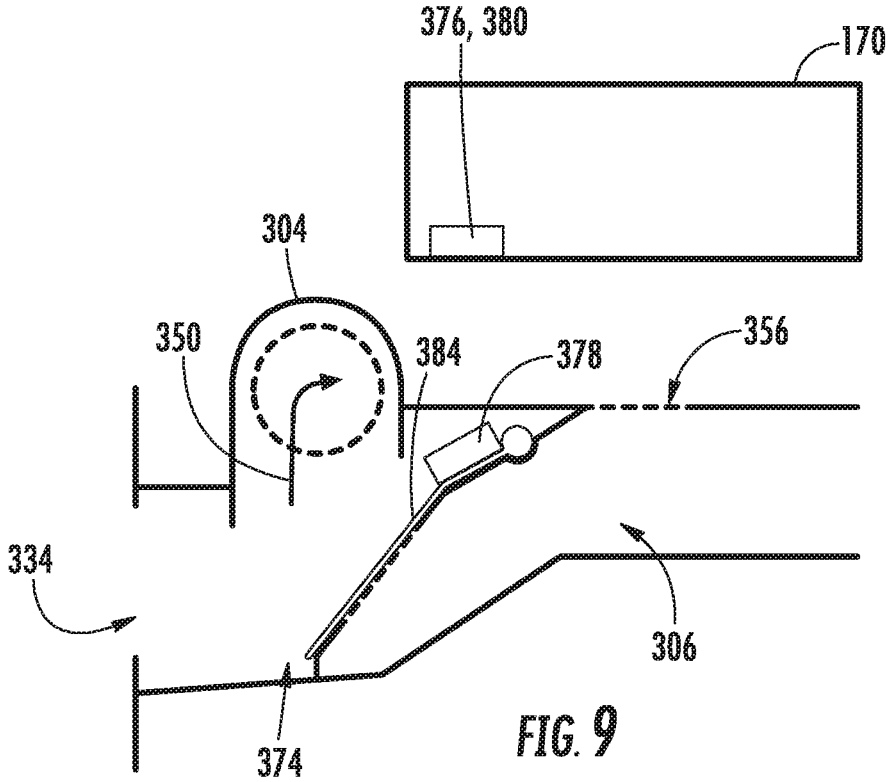
FIG. 9 provides a schematic sectional view of a portion of a variable jet assembly according to exemplary embodiments of the present disclosure, wherein the variable jet assembly is in a first zone position.
Figure 10:
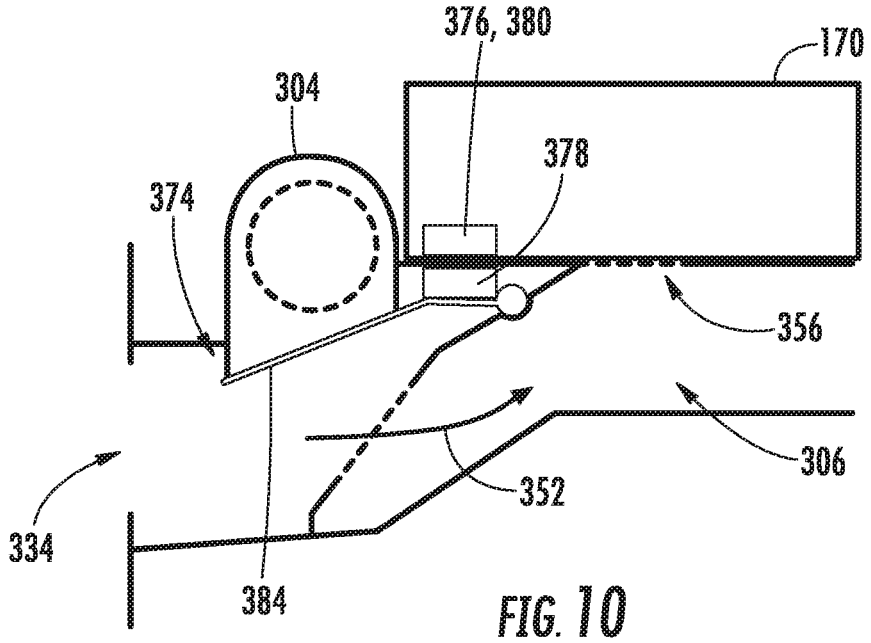
FIG. 10 provides a schematic sectional view of a portion of the exemplary diverter valve of FIG. 9, wherein the variable jet assembly is in a second zone position.

Turning briefly to FIGS. 9 and 10, in additional or alternative embodiments, diverter valve 374 includes a flapper arm 384. Flapper arm 384 may pivot within manifold to selectively close first flow path 350 and second flow path 352 (e.g., place diverter valve 374 in the second zone position and first zone position, respectively). Flapper arm 384 may further include or be fixed to first magnetic element 378 such that flapper arm 384 pivots or lifts in tandem with first magnetic element 378.

Returning generally to FIGS. 4 and 7 through 10, in optional embodiments, driver 376 may be mounted to a separable or removable element, such as basket 170. In some such embodiments, second magnetic element 380 is fixed to basket 170. Second magnetic element 380 may further be in matched alignment with first magnetic element 378 such that placing basket 170 within the first spray zone placed second magnetic element 380 in magnetic engagement with first magnetic element 378. The magnetic engagement may hold diverter valve 374 in the second zone position (e.g., until basket 170 is removed from the first spray zone and gravity or water pressure motivates diverter valve 374 to the first zone position).

Although second magnetic element 380 is shown mounted to basket 170, it is understood that second magnetic element 380 may be attached or fixed to any element movable within respect to manifold body 304 (e.g., when manifold body 304 is received within wash chamber 106 or wash compartment 319). For instance, alternative embodiments may provide second magnetic element 380 on a linear actuator controlled by controller 146 to move second magnetic element 380 toward or away from manifold body 304, and thus first magnetic element 378 (e.g., based on a selected wash cycle). Moreover, it is understood that further additional or alternative embodiments may provide second magnetic element 380 on any other suitable feature or location of dishwashing appliance 100.

Figure 11:
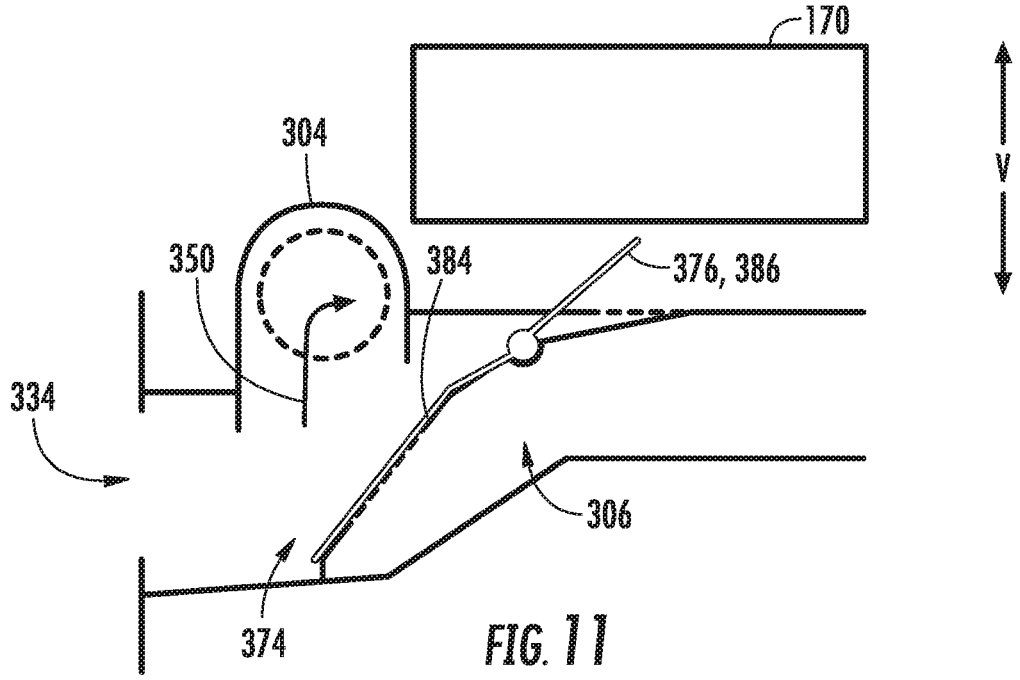
FIG. 11 provides a schematic sectional view of a portion of a variable jet assembly according to exemplary embodiments of the present disclosure, wherein the variable jet assembly is in a first zone position.
Figure 12:
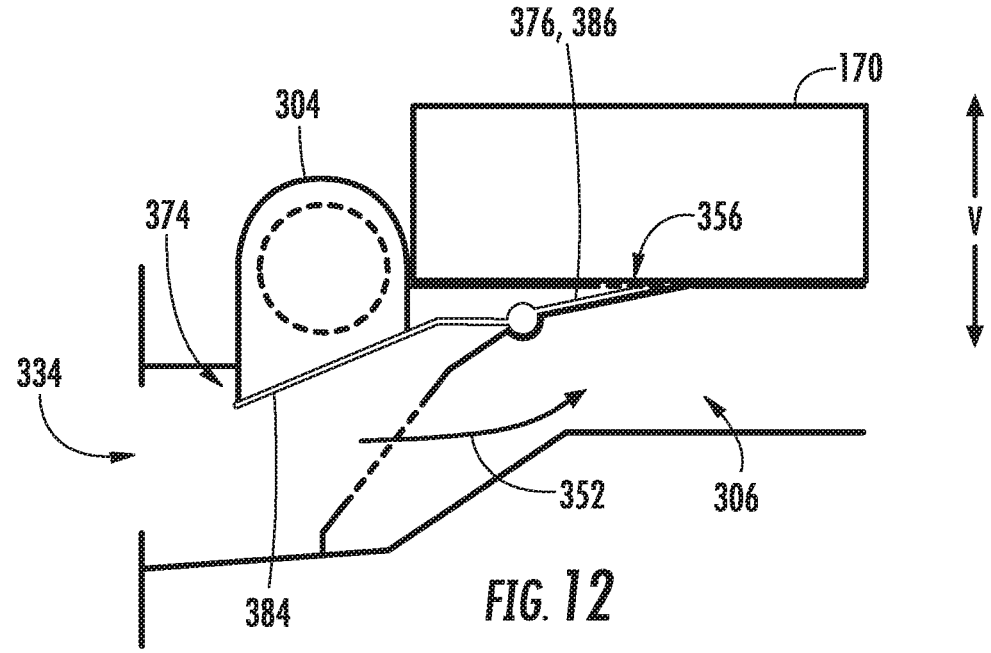
FIG. 12 provides a schematic sectional view of a portion of the exemplary diverter valve of FIG. 11, wherein the variable jet assembly is in a second zone position.

Turning especially to FIGS. 11 and 12, in some embodiments, driver 376 may be mechanically linked to a portion of diverter valve 374. For instance, driver 376 may include a diverter arm 386 in mechanical communication (e.g., directly or indirectly, such as through a series of gears) with diverter valve 374. As shown, diverter arm 386 may extend outward from an internal portion of manifold body 304. Optionally, diverter arm 386 may be fixed a flapper arm 384 of diverter valve 374. Additionally or alternatively, diverter arm 386 may extend to or above the first spray zone. As shown, placing an article, such as basket 170, on diverter arm 386 may move or actuate diverter valve 374 (e.g., at flapper arm 384). For instance, when an article (e.g., basket 170) is placed on diverter arm 386, diverter arm 386 may cause flapper arm 384 to pivot within manifold to selectively close first flow path 350 (e.g., to place diverter valve 374 in the second zone position). In some such embodiments, basket 170 is thus in selective engagement with the diverter valve 374. Moreover, the basket 170 may be receivable over the second spray outlet 356 in mechanical communication with the diverter valve 374 to motivate the diverter valve 374 to the second zone position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A variable spray assembly for a dishwashing appliance, the variable spray assembly comprising:

a rack assembly;

a manifold body mountable within a wash chamber of the dishwashing appliance, the manifold body defining a fluid inlet to receive a wash fluid within the manifold body, a first flow path downstream from the fluid inlet, a second flow path downstream from the fluid inlet and in fluid parallel to the first flow path, a first spray outlet downstream from the first flow path and directed into the rack assembly, and a second spray outlet downstream from the second flow path, the second spray outlet being directed into the rack assembly and spaced apart from the first spray outlet;

a diverter valve mounted within manifold body downstream from the fluid inlet, the diverter valve comprising a first magnetic element that is movable between a first zone position directing wash fluid to the first flow path and a second zone position directing wash fluid to the second flow path;

a basket selectively received on the rack assembly; and a driver disposed outside of the manifold body in selective engagement with the diverter valve to motivate the diverter valve between the first zone position and the second zone position, wherein the driver comprises a second magnetic element disposed within the basket and in selective magnetic engagement with the first magnetic element to motivate the diverter valve from the first zone position to the second zone position in response to the reception of the basket on the rack assembly, and wherein the manifold body is mounted to the rack assembly, and wherein the driver comprises a second magnetic element disposed within the basket and in selective magnetic engagement with the first magnetic element to motivate the diverter valve from the first zone position to the second zone position in response to the reception of the basket on the rack assembly.

2. The variable spray assembly of claim 1, wherein the rack assembly is slidably disposed within the wash chamber above the variable spray assembly.

3. The variable spray assembly of claim 1, wherein the first magnetic element comprises a stopper ball slidably disposed within the manifold body.

4. The variable spray assembly of claim 1, wherein the diverter valve further comprises a flapper arm fixed to the first magnetic element.

5. The variable spray assembly of claim 1, wherein the basket is receivable over the second spray outlet such that the basket is in communication with the diverter valve to motivate the diverter valve to the second zone position.

6. The variable spray assembly of claim 1, further comprising:

a pump configured to deliver a wash fluid into the wash chamber; a fluid conduit fixed within the wash chamber, the fluid conduit extending in fluid communication between the pump and the fluid inlet.

7. The variable spray assembly of claim 1, wherein the manifold body comprises a base housing the diverter valve, and a vertical tine attached to the base, the vertical tine defining the first spray outlet and at least a portion of the first flow path.

8. The variable spray assembly of claim 1, wherein the first spray outlet comprises a plurality of fluid-parallel outlets, and wherein the second spray outlet comprises a plurality of fluid-parallel outlets.

9. A dishwashing appliance, the dishwashing appliance comprising:

a tub defining a wash chamber;

a pump configured to deliver a wash fluid into the wash chamber;

a spray assembly housed within the wash chamber of the tub in fluid communication with the pump to receive wash fluid therefrom;

a rack assembly slidably disposed within the wash chamber;

a basket selectively received on the rack assembly; and a variable spray assembly housed within the wash chamber of the tub in fluid communication with the pump to receive wash fluid therefrom, the variable spray assembly comprising a manifold body defining a fluid inlet to receive a wash fluid within the manifold body, a first flow path downstream from the fluid inlet, a second flow path downstream from the fluid inlet and in fluid parallel to the first flow path, a first spray outlet downstream from the first flow path and directed into the rack assembly, and a second spray outlet downstream from the second flow path, the second spray outlet being directed into the rack assembly and spaced apart from the first spray outlet, a diverter valve mounted within manifold body downstream from the fluid inlet, the diverter valve comprising a first magnetic element that is movable between a first zone position directing wash fluid to the first flow path and a second zone position directing wash fluid to the second flow path, and a driver disposed outside of the manifold body in selective engagement with the diverter valve to motivate the diverter valve between the first zone position and the second zone position, wherein the driver comprises a second magnetic element disposed within the basket and in selective magnetic engagement with the first magnetic element to motivate the diverter valve from the first zone position to the second zone position in response to the reception of the basket on the rack assembly, and wherein the manifold body is mounted to the rack assembly, and wherein the driver comprises a second magnetic element disposed within the basket and in selective magnetic engagement with the first magnetic element to motivate the diverter valve from the first zone position to the second zone position in response to the reception of the basket on the rack assembly.

10. The dishwashing appliance of claim 9, wherein the first magnetic element comprises a stopper ball slidably disposed within the manifold body.

11. The dishwashing appliance of claim 9, wherein the diverter valve further comprises a flapper arm fixed to the first magnetic element.

12. The dishwashing appliance of claim 9, wherein the basket is receivable over the second spray outlet such that the basket is in communication with the diverter valve to motivate the diverter valve to the second zone position.

13. The dishwashing appliance of claim 9, further comprising:

a fluid conduit fixed to the tub within the wash chamber, the fluid conduit extending in fluid communication between the pump and the fluid inlet.

14. The dishwashing appliance of claim 9, wherein the manifold body comprises a base housing the diverter valve, and a vertical tine attached to the base, the vertical tine defining the first spray outlet and at least a portion of the first flow path.

15. The dishwashing appliance of claim 9, wherein the first spray outlet comprises a plurality of fluid-parallel outlets, and wherein the second spray outlet comprises a plurality of fluid-parallel outlets.

* * * * *